US008758531B1

(12) United States Patent
Schneider et al.

(10) Patent No.: US 8,758,531 B1
(45) Date of Patent: Jun. 24, 2014

(54) CATALYTIC HYPERGOLIC BIPROPELLANTS

(75) Inventors: Stefan Schneider, Palmdale, CA (US); Tommy W. Hawkins, Lancaster, CA (US); Yonis Ahmed, Lancaster, CA (US); Michael Rosander, Lancaster, CA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 13/047,902

(22) Filed: Mar. 15, 2011

(51) Int. Cl.
*C06B 47/00* (2006.01)

(52) U.S. Cl.
USPC ..... 149/1; 149/109.2

(58) Field of Classification Search
USPC ..... 149/1, 109.2
See application file for complete search history.

(56) References Cited

U.S. PATENT DOCUMENTS

| | | | | |
|---|---|---|---|---|
| 3,552,127 | A | 1/1971 | Morrell | |
| 5,932,837 | A | 8/1999 | Rusek et al. | |
| 6,045,638 | A | 4/2000 | Lundstrom | |
| 6,218,577 | B1 | 4/2001 | Brand et al. | |
| 6,378,291 | B1 * | 4/2002 | Schneider | 60/218 |
| 6,509,473 | B1 | 1/2003 | Drake | |
| 6,588,199 | B2 * | 7/2003 | Stechman et al. | 60/258 |
| 6,695,938 | B2 | 2/2004 | Diede | |
| 7,550,601 | B1 | 6/2009 | Drake et al. | |
| 7,645,883 | B1 | 1/2010 | Hawkins et al. | |
| 7,745,635 | B1 | 6/2010 | Drake et al. | |
| 8,034,202 | B1 | 10/2011 | Hawkins et al. | |
| 2003/0192633 | A1 | 10/2003 | Diede | |
| 2004/0221933 | A1 | 11/2004 | Hallit et al. | |
| 2005/0022911 | A1 | 2/2005 | Rusek et al. | |
| 2005/0269001 | A1 | 12/2005 | Liotta et al. | |
| 2006/0041175 | A1 | 2/2006 | Thorn et al. | |

OTHER PUBLICATIONS

United States Patent and Trademark Office, Second Advisory Action in U.S. Appl. No. 10/816,032, mailed Dec. 13, 2011, 2 pages.
United States Patent and Trademark Office, Third Final Office Action in U.S. Appl. No. 10/816,032, mailed Sep. 29, 2011, 7 pages.
United States Patent and Trademark Office, Third Non-Final Office Action in U.S. Appl. No. 10/816,032, mailed Mar. 25, 2011, 7 pages.
United States Patent and Trademark Office, Second Final Office Action in U.S. Appl. No. 10/816,032, mailed Oct. 27, 2009, 6 pages.
United States Patent and Trademark Office, Second Non-Final Office Action in U.S. Appl. No. 10/816,032, mailed Apr. 13, 2009, 6 pages.
United States Patent and Trademark Office, First Advisory Action in U.S. Appl. No. 10/816,032, mailed Dec. 16, 2008, 3 pages.
United States Patent and Trademark Office, First Final Office Action in U.S. Appl. No. 10/816,032, mailed Oct. 27, 2008, 5 pages.
United States Patent and Trademark Office, First Non-Final Office Action in U.S. Appl. No. 10/816,032, mailed May 3, 2007, 4 pages.
United States Patent and Trademark Office, First Non-Final Office Action in U.S. Appl. No. 12/567,110, mailed Sep. 16, 2011, 8 pages.
United States Patent and Trademark Office, First Final Office Action in U.S. Appl. No. 12/567,110, mailed Dec. 28, 2011, 10 pages.
United States Patent and Trademark Office, First Advisory Action in U.S. Appl. No. 12/567,110, mailed Jan. 11, 2012, 2 pages.
United States Patent and Trademark Office, Second Advisory Action in U.S. Appl. No. 12/567,110, mailed Mar. 1, 2012, 3 pages.
United States Patent and Trademark Office, Second Non-Final Office Action in U.S. Appl. No. 12/567,110, mailed Dec. 3, 2012, 11 pages.
S. Schneider et al., "Ionic liquids as hypergolic fuels," Energy & Fuels, vol. 22 (2008) 2871-2872.
S. D. Chambreau et al., "Fourier transform infrared studies in hypergolic ignition of ionic liquids," J. Phys. Chem. A., vol. 112 (2008) 7816-7824.
S. Schneider et al., Preprint of "Liquid azide salts and their reactions with common oxidizers IRFNA and N2O4," which was published in Inorg. Chem., vol. 47 (2008) 6082-6089.
United States Patent and Trademark Office, Second Non-Final Office Action in U.S. Appl. No. 12/567,136, mailed Dec. 10, 2012, 10 pages.
United States Patent and Trademark Office, Second Advisory Action in U.S. Appl. No. 12/567,136, mailed Mar. 2, 2012, 3 pages.
United States Patent and Trademark Office, First Advisory Action in U.S. Appl. No. 12/567,136, mailed Jan. 11, 2012, 2 pages.
United States Patent and Trademark Office, First Final Office Action in U.S. Appl. No. 12/567,136, mailed Dec. 28, 2011, 9 pages.
United States Patent and Trademark Office, First Non-Final Office Action in U.S. Appl. No. 12/567,136, mailed Sep. 15, 2011, 7 pages.
United States Patent and Trademark Office, Second Final Office Action in U.S. Appl. No. 12/567,136, mailed May 20, 2013, 10 pages.

(Continued)

*Primary Examiner* — Aileen B Felton
(74) *Attorney, Agent, or Firm* — AFMCLO/JAZ; Chastity Whitaker

(57) ABSTRACT

Provided is a fuel of catalytic metal-containing ionic liquid (MCIL) and an IL, to spur hypergolic ignition of such liquids upon contact with an oxidizer to define a hypergolic bipropellant.

19 Claims, No Drawings

(56) References Cited

OTHER PUBLICATIONS

United States Patent and Trademark Office, Second Final Office Action in U.S. Appl. No. 12/567,110, mailed Jun. 5, 2013, 10 pages.
United States Patent and Trademark Office, Fourth Final Office Action in U.S. Appl. No. 10/816,032, mailed Jun. 7, 2013, 8 pages.
R. Wang et al., "Furazan-functionalized tetrazolate-based salts: a new family of insensitive energetic materials," Chem. Eur. J., vol. 15 (2009) 2625-2634.
United States Patent and Trademark Office, Non-Final Office Action in U.S. Appl. No. 13/107,488, mailed Oct. 24, 2013, 5 pages total.
"Ionic Liquids as Hypergolic Fuels" Stefan Schneider et al., published on Jun. 17, 2008 in the Journal of Energy and Fuels vol. 22, p. 2871; see http//pubs.asc.org/journal/enfuem.

* cited by examiner

CATALYTIC HYPERGOLIC BIPROPELLANTS

STATEMENT OF GOVERNMENT INTEREST

The invention described herein may be manufactured and used by or for the Government for governmental purposes without the payment of any royalty thereon.

CROSS REFERENCE TO RELATED APPLICATION

This Application relates to patent application Ser. No. 11/973, 978 entitled "Hypergolic Fuels" by Hawkins et al., filed 4 Oct. 2007.

FIELD OF THE INVENTION

This invention relates to bipropellants, particularly catalytically enhanced bipropellants.

BACKGROUND OF THE INVENTION

The state-of-the-art, storable bipropulsion system uses hydrazine (typically monomethylhydrazine) as the fuel component. This fuel affords useful performance characteristics and has a fast ignition with the oxidizer. This fast (hypergolic) ignition provides system reliability for on-demand action of the propulsion system. The bipropellant's hypergolic character is very beneficial as it removes the requirement of a separate ignition component. Additional components may be added to bring increased inert mass and reduce system performance. The energy density of the state-of-the-art, storable bipropulsion system is largely limited by the density of the fuel. Storable fuels range in density from 0.88 g/cc (monomethylhydrazine) to 1.00 g/cc (hydrazine). Energetic ionic liquids have established densities that range well above 1.00 g/cc, and thus can confer greater energy density as bipropellant fuels.

There are significant costs and operational constraints associated with handling state-of-the-art fuels (hydrazines) that derive from the fuel's carcinogenic vapor. Fuel transport, loading, and unloading are significantly complicated by vapor toxicity and can require considerable effort and cost in vapor monitoring by trained operations crews employed in expensive personal protection equipment.

One major drawback of recently discovered hypergolic ionic liquids is that the majority are hypergolic only with nitric acid in one of its several formulations. Furthermore, only very few have been shown to be hypergolic with higher performing $N_2O_4$. By their very nature, oxidizers are hazardous; however, the toxicity and corrosiveness of the nitric acids make operability quite difficult. While $N_2O_4$ is much less corrosive and easier to handle than IRFNA (inhibited, red-fuming nitric acid comprising about 83% $HNO_3$, 14% $N_2O_4$, about 2% $H_2O$, and 0.6% HF), it is highly toxic with an even higher vapor pressure than hydrazine (101 kPa at 21° C. for $NO_2$ or $N_2O_4$). A true "all-green" bi-propulsion system has to address the toxicity of the oxidizer. Hydrogen peroxide is the only known, high performing, storable oxidizer, which can be considered environmentally benign. Although the OSHA permissible exposure limit for hydrogen peroxide is only 1 ppm in air, the high boiling points of the water solutions, 141° C. (90%) and 148° C. (98%), result in vapor pressures at 25° C. of only 0.5 KPa and 0.3 KPa for 90% and 98% hydrogen peroxide, respectively, which makes handling of the oxidizer considerable less difficult than $N_2O_4$.

Accordingly, there is need and market for environmentally enhanced "green" ionic liquid fuels, which overcome the above prior art shortcomings.

SUMMARY OF THE INVENTION

Broadly, the invention provides a hypergolic bipropellant comprising first and second ionic liquids, wherein the second ionic liquid is a metal-containing ionic liquid, and hydrogen peroxide operable as an oxidizer. The second ionic is configured to catalyze hypergolic ignition.

DESCRIPTION OF PREFERRED EMBODIMENTS

Referring to the present invention in detail, advanced bipropellant fuels with fast ignition upon mixing with 90% and 98% hydrogen peroxide have been synthesized and demonstrated. Principally, the bipropellant fuels are a mixture of at least two ionic liquids, wherein at least one of the ionic liquids is a transition metal-containing ionic liquid, preferably with the metal incorporated in the anion of the ionic liquid. The metal-containing ionic liquids serve as catalysts for the accelerated decomposition of hydrogen peroxide and do not have to be hypergolic with hydrogen peroxide by themselves. The mixture of the metal-containing ionic liquid with the other ionic liquid is fast igniting (hypergolic) upon contact with hydrogen peroxide. The fast igniting ionic liquid mixture contains about 0.1% to 35% of the metal-containing ionic liquid.

The other ionic liquid mixture may largely contain the other ionic liquid. Stability and reactivity of the overall mixture dictates the selection of the ionic liquid.

The reactivity of the mixture is influenced by selection of the cation as well as the anion (Table 1). Anions of the non-metallate carrying ionic liquid can contain nitrates, perchlorates, dinitramides, azides, cyanides, dicyanamides, tricyanomethanides, and azolates.

Cations present in the ionic liquid mixture of the bipropellant fuel may be selected from open-chain substituted ammonium, substituted pyrrolidinium, piperidinium, triazolium, tetrazolium, and imidazolium groups, as shown in the formulas below.

a)

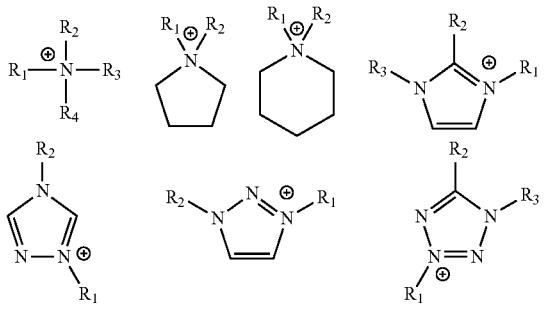

where $R_1$, $R_2$, $R_3$, $R_4$ is H, $NH_2$, or $C_1$-$C_6$.

Suitable anions for the above cations in the above IL mixture are shown below.

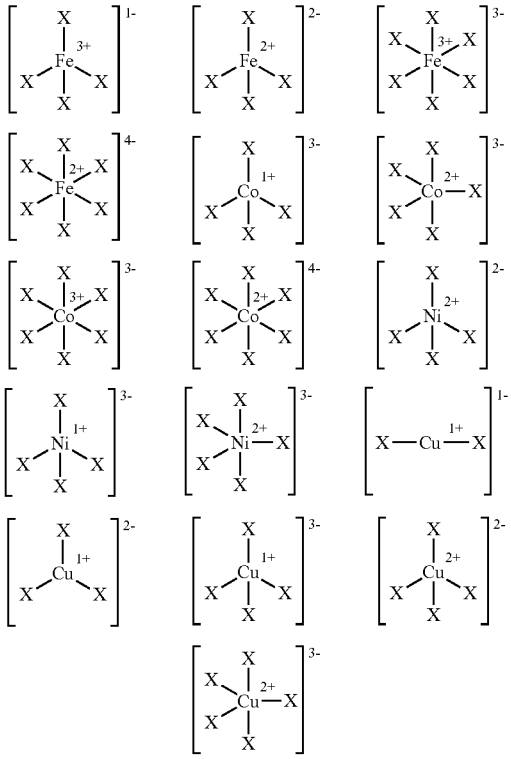

where X is Cl, Br, $BH_4$, $NO_3$, CN, —CC—, —OMe, or $N_3$.

The determination of reactivity of metallate-based ionic liquids and mixtures thereof with hydrogen peroxide (both 90% and 98%) was performed. The experimental results are shown in the table below. Fast ignition is generally observed with the ionic liquid fuel mixture upon contact with the liquid oxidizer. Examples 1-5 include simple drop tests of mixtures of the following ionic liquids and hydrogen peroxide (90 wt. % and 98 wt. %):

BMIM Fe

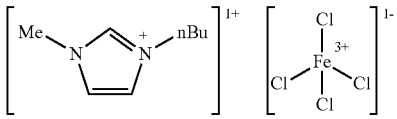

BMIM Azide

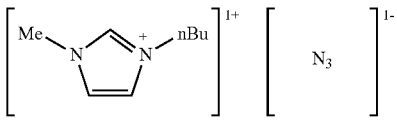

HEHN

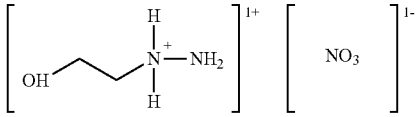

DMAZ TF

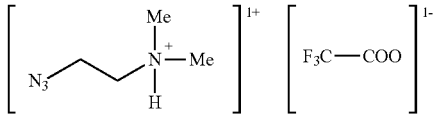

-continued

TMAZ DCA

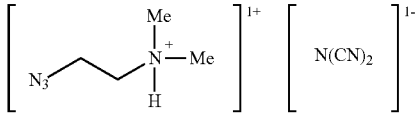

TABLE 1

IGNITION RESPONSE OF IONIC LIQUID-BASED FUEL MIXTURES WITH HYDROGEN PEROXIDE

| BMIM $FeCl_4$ [weight %] | BMIM Azide [weight %] | HEHN [weight %] | DMAZ TF [weight %] | TMAZ DCA [weight %] | 90% $H_2O_2$ ID [ms][1] | 98% $H_2O_2$ ID [ms][1] |
|---|---|---|---|---|---|---|
| 100 | 0 | 0 | 0 | 0 | vd[2] | vd[2] |
| 14 | 86 | 0 | 0 | 0 | nd[3] | 170 |
| 22 | 0 | 78 | 0 | 0 | nd[3] | 50 |
| 20 | 0 | 0 | 80 | 0 | 880 | 960 |
| 8 | 0 | 0 | 0 | 92 | 110 | 130 |

ID: Ignition delay time (time of first visible flame),
[2]vd: violent decomposition,
[3]nd: not determined In the preferred embodiment of the invention, both the cation and anion structures are chosen to confer low melting points and low viscosity while also incorporating structures that increase heat of combustion of the fuel with the storable liquid oxidizer. Such substituent (i.e., R-group) structures can be strained-ring (e.g., cyclopropyl-), high-nitrogen moieties (e.g., azido- or cyano-), or high hydrogen moieties (e.g. aminoborane-). Thus, it is an object of the present invention to provide an ionic liquid that accelerates the decomposition of hydrogen peroxide. The metal-containing ionic liquid may include a transition metal, preferably iron, cobalt, nickel, or copper incorporated in the anion. Such an ionic liquid can be combined with another, nonmetal-containing ionic liquid. The nonmetal-containing ionic liquid delivers the energy density of the bipropellant fuel and having hypergolic properties with hydrogen peroxide.

In sum, ionic liquids have established characteristics of negligible vapor toxicity and higher density than typical propulsion fuels (e.g., hydrocarbons and hydrazines). The design and development of energy dense, fast-igniting ionic liquids as fuels for bipropellants can provide improved handling characteristics (due to lower toxicity hazard) and lower operations cost. In addition, such fuels can impart greater performance capabilities, such as, increased velocity, range, or system lifetime.

That is, the invention provides hypergolic bipropellant fuels, designed for fast ignition upon mixing with 70% to 100% $H_2O_2$ and preferably 90% to 98% $H_2O_2$, including 90% and 98% $H_2O_2$ that have been synthesized and demonstrated. The bipropellant fuels are based upon salts, particularly ionic liquids, which include a metal-containing ionic liquid and a non metal-containing ionic liquid. The metal-containing ionic liquids herein are designed to accelerate the decomposition of hydrogen peroxide. The non metal-containing ionic liquids are design to impart low melting point, high energy density, and stable molecules.

Fast igniting, ionic liquid fuels provide a means to overcome significant limitations of the state-of-the-art of storable bipropulsion system. Such ionic liquid fuels can provide greater than 45% improvement in density over hydrazine fuels. This confers greater energy density to the bipropulsion system. Also, the negligible vapor pressure of ionic liquid fuels provides an outstanding means of significantly reducing costs and operational constraints associated with handling this fuel.

Thus, per the invention, the discovery of an ionic liquid that can accelerate the decomposition of hydrogen peroxide and serve as a catalyst for hypergolic ignition allows for the attainment of high energy density ionic liquid fuels. Such fuels were conventionally disregarded due to a perceived lack of reactivity with hydrogen peroxide. Now, however, per the present invention, such ionic liquids can be employed to provide a hypergolic bipropellant with significant performance increases over the prior art and with the bonus of using both a fuel and oxidizer that are "green."

The preferred embodiment of the invention is the employment of an exclusive mixture of at least two ionic liquids, wherein one of the ionic liquids includes an iron, cobalt, nickel, or copper metallate anion to serve as a catalyst in the decomposition of hydrogen peroxide. The other ionic liquid has an energy density that is fast igniting with hydrogen peroxide. Additionally, the use of the metallate ionic liquid as a single component bipropellant fuel to confer fast-ignition and density is also seen as a viable mode of the invention.

A hypergolic bipropellant based upon a fuel mixture of at least two ionic liquids, of which at least one is a metal-containing ionic liquid, and 70 wt. % to 100 wt. % (preferably 90 wt. % to 98 wt. %) of hydrogen peroxide as an oxidizer has potential as a replacement for bipropellants currently used in on-orbit spacecraft propulsion. Other application areas may include liquid engines for boost and divert propulsion. The high energy density that is inherent in the new hypergolic bipropellant lends itself to applications that require high performance from volume limited systems. The low vapor toxicity of the ionic liquid fuel is a benefit over toxic hydrazine fuels currently used.

This new hypergolic bipropellant can find use in commercial applications, e.g., in satellite deployment and commercial space launch activities.

What is claimed is:

1. A hypergolic bipropellant comprising:

a first ionic liquid;

a second, metal-containing ionic liquid; and $H_2O_2$ operable as an oxidizer, wherein the second ionic liquid is configured to catalyze hypergolic ignition.

2. The hypergolic bipropellant of claim 1, wherein a cation of the first ionic liquid, the second ionic liquid, or both is selected from the group consisting of:

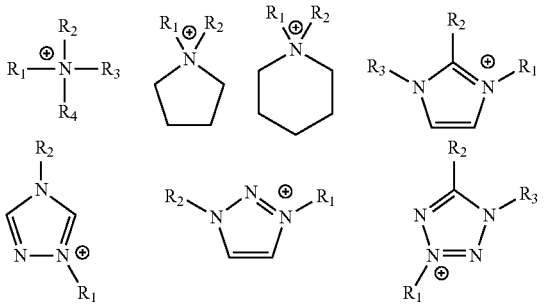

where $R_1$, is H, $NH_2$, or a $C_1$-$C_6$ alkyl; $R_2$ is H, $NH_2$, or a $C_1$-$C_6$ alkyl; $R_3$ is H, $NH_2$, or a $C_1$-$C_6$ alkyl; and $R_4$ is H, $NH_2$, or a $C_1$-$C_6$ alkyl.

3. The hypergolic bipropellant of claim 1, wherein an anion of the first ionic liquid, the second ionic liquid, or both is selected from the group consisting of:

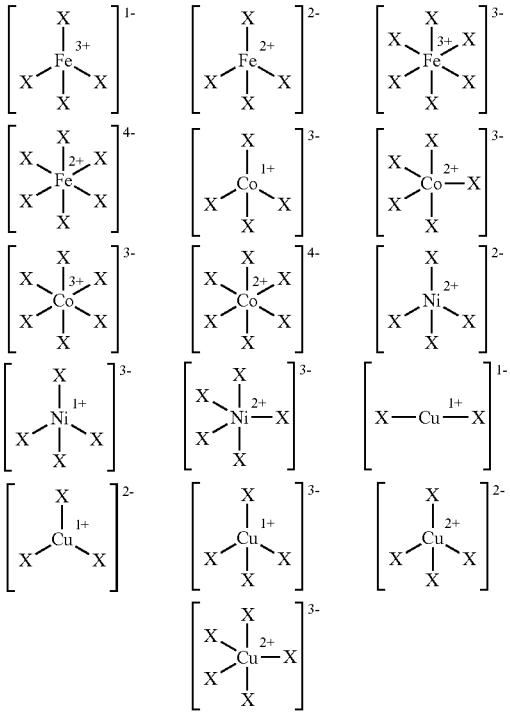

where X is Cl, Br, $BH_4$, $NO_3$, CN, —CC—, —OMe or $N_3$.

4. The hypergolic bipropellant of claim 1, wherein a weight percent of the $H_2O_2$ ranges from 70 weight percent to 100 weight percent.

5. The hypergolic bipropellant of claim 4, wherein the weight percent of the $H_2O_2$ ranges from 90 weight percent to 98 weight percent.

6. A method of preparing a hypergolic bipropellant, the method comprising, providing a mixture comprising a first ionic liquid and a second ionic liquid, wherein at least one of the first and second ionic liquids is a metal-containing ionic liquid providing $H_2O_2$ as oxidizer.

7. The method of claim 6, wherein the second ionic liquid includes a metallate.

8. The method of claim 6, wherein a cation of the second ionic liquid is selected from the group consisting of:

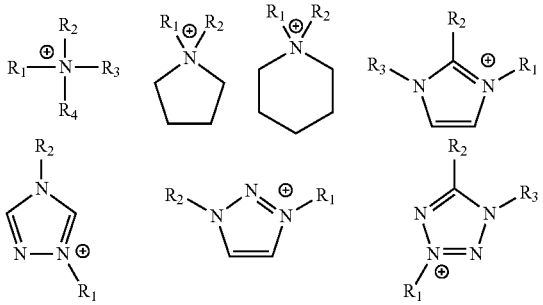

where each of $R_1$, $R_2$, $R_3$, and $R_4$ is separately selected from H, $NH_2$, and a $C_1$-$C_6$ alkyl.

9. The method of claim 7, wherein the metallate is selected from the group consisting of:

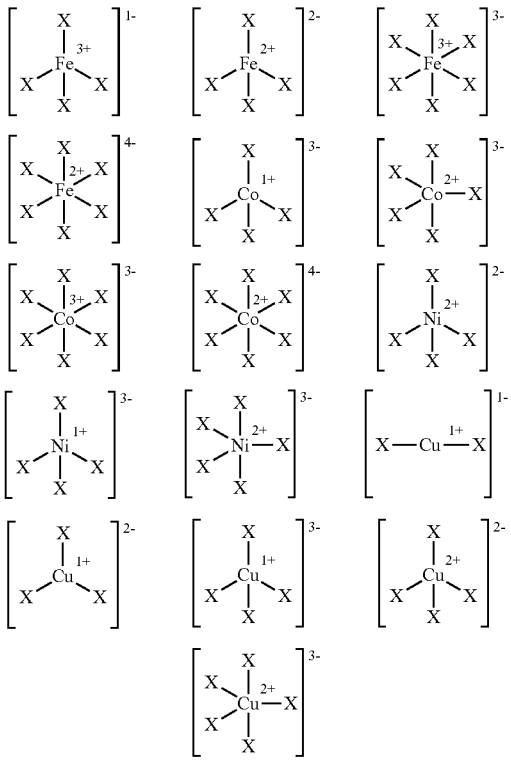

where X is Cl, Br, $BH_4$, $NO_3$, CN, —CC—, —OMe, or $N_3$.

10. The method of claim 6, wherein a weight percent of the $H_2O_2$ ranges from 70 weight percent to 100 weight percent.

11. The method of claim 6, wherein the weight percentage of the $H_2O_2$ ranges from 90 weight percent to 98 weight percent.

12. The hypergolic bipropellant of claim 1, wherein a cation of the second ionic liquid is:

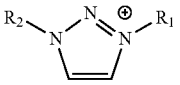

where each of $R_1$ and $R_2$ is separately selected from H, $NH_2$, or a $C_1$-$C_6$.

13. The hypergolic bipropellant of claim 1, wherein a metallate of the second ionic liquid is:

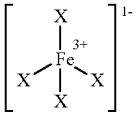

where X is Cl, Br, $BH_4$, $NO_3$, CN, —CC—, —OMe, or $N_3$.

14. The hypergolic bipropellant of claim 13, wherein a cation of the second ionic liquid is:

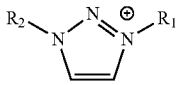

where each of $R_1$ and $R_2$ is separately selected from H, $NH_2$, or a $C_1$-$C_6$ alkyl.

15. The hypergolic bipropellant of claim 1, wherein a cation of the first ionic liquid is selected from the group consisting of:

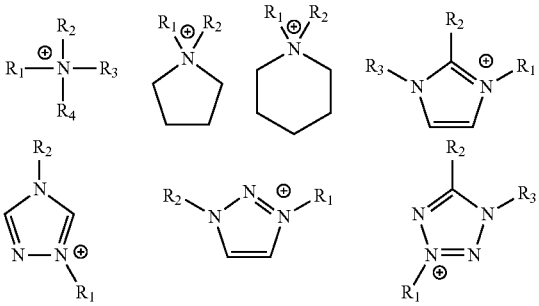

where each of $R_1$, $R_2$, $R_3$, and $R_4$ is separately selected from H, $NH_2$, and a $C_1$-$C_6$ alkyl.

16. The hypergolic bipropellant of claim 1, wherein an anion of the first ionic liquid is selected from a group consisting of nitrates, perchlorates, dinitramides, azides, cyanides, dicyanamides, tricyanomethanides, and azolates.

17. The hypergolic bipropellant of claim 1, wherein the metal of the second ionic liquid is a transition metal.

18. The hypergolic bipropellant of claim 1, wherein cations of each of the first and second ionic liquids is a substituted triazolium cation, a metallate of the second ionic liquid is a tetrahedrally coordinated Fe(III) anion, and an anion of the first ionic liquid is an azolate anion.

19. The hypergolic bipropellant of claim 1, wherein cations of the first and second ionic liquids are selected from the group consisting of an open-chain substituted ammonium, a substituted pyrrolidinium, a substituted piperidinium, a substituted triazolium, a substituted tetrazolium, and a substituted imidazolium.

* * * * *